United States Patent [19]

Smith

[11] Patent Number: 4,903,438

[45] Date of Patent: Feb. 27, 1990

[54] SHARPENING DEVICE

[76] Inventor: Richard S. Smith, 203 S. Summertime, Hot Springs, Ark. 71913

[21] Appl. No.: 118,327

[22] Filed: Nov. 6, 1987

[51] Int. Cl.[4] ..... B23F 21/03

[52] U.S. Cl. ..... 51/211 R

[58] Field of Search ..... 51/204, 205 R, 211 R

[56] References Cited

U.S. PATENT DOCUMENTS

| | | | |
|---|---|---|---|
| 147,842 | 2/1874 | Hull | 51/211 R |
| 973,968 | 10/1910 | Pike | 51/211 R |
| 1,294,616 | 2/1919 | Carlson | 51/211 R |
| 1,935,592 | 11/1933 | Stivers | 51/211 R |
| 3,280,514 | 10/1966 | Raymond | 51/211 R |
| 3,721,049 | 3/1973 | Nakahara | 51/211 R |
| 4,212,136 | 7/1980 | Stertzbach | 51/331 |

*Primary Examiner*—Rodney B. Bovernick
*Assistant Examiner*—Jay P. Ryan
*Attorney, Agent, or Firm*—Berman, Aisenberg & Platt

[57] ABSTRACT

A sharpening stone holding device is for supporting a plurality of sharpening stones. The device is adjustable for holding stones of different lengths.

16 Claims, 3 Drawing Sheets

SHARPENING DEVICE

FIELD OF THE INVENTION

The invention relates to devices having a plurality of sharpening stones for sharpening blades.

BACKGROUND OF THE INVENTION

Several known sharpening devices have multiple stones for use according to the type of blade to be sharpened. A stone holding device of this type is oriented according to the stone to be used. Gallagher, U.S.P. 1,946,968, shows a device used for oil stone sharpening apparatus. The device of Gallagher may have three or four stones, and the container is partially filled with oil to lubricate the abrading surface of the stone being used. The patent to Stivers, U.S. Pat. No. 1,959,647, similarly shows a three-stone device, supported in a bath of oil.

The patent to Sorensen, U.S. Pat. No. 1,998,259, also shows a three-stone device, as does Teague, U.S. Pat. No. 2,558,325.

Graves, U.S. Pat. No. 4,530,188, shows a pocket-sized sharpening apparatus having two sharpening rods, and Cohen, U.S. Pat. No. 4,611,437, shows an apparatus having three sharpening rods.

The patent to Nakahara, U.S. Pat. No. 3,721,049, shows a base for a whetstone which has adjustable supporting means for a stone, which may be adjusted according to the length of sharpening stone to be used. The device is capable of supporting only one stone.

SUMMARY OF THE INVENTION

The device of the invention is illustrated accommodating four sharpening stones of equal length. Other arrangements of a greater or lesser number of stones are within scope of the invention.

The sharpening device of the invention includes a support for multiple sharpening stones adaptable for holding stones of different lengths. The support for the stones includes grooves for engaging a stone-holding retainer. The grooves are spaced away from each other according to the length of the sharpening stones used, and retaining members for the stones are engaged with grooves selected according to the length of the sharpening stones.

It is an object of the invention to provide a stone sharpening device adapted for holding multiple stones of different lengths.

DETAILED DESCRIPTION OF THE INVENTION

Figure 1:
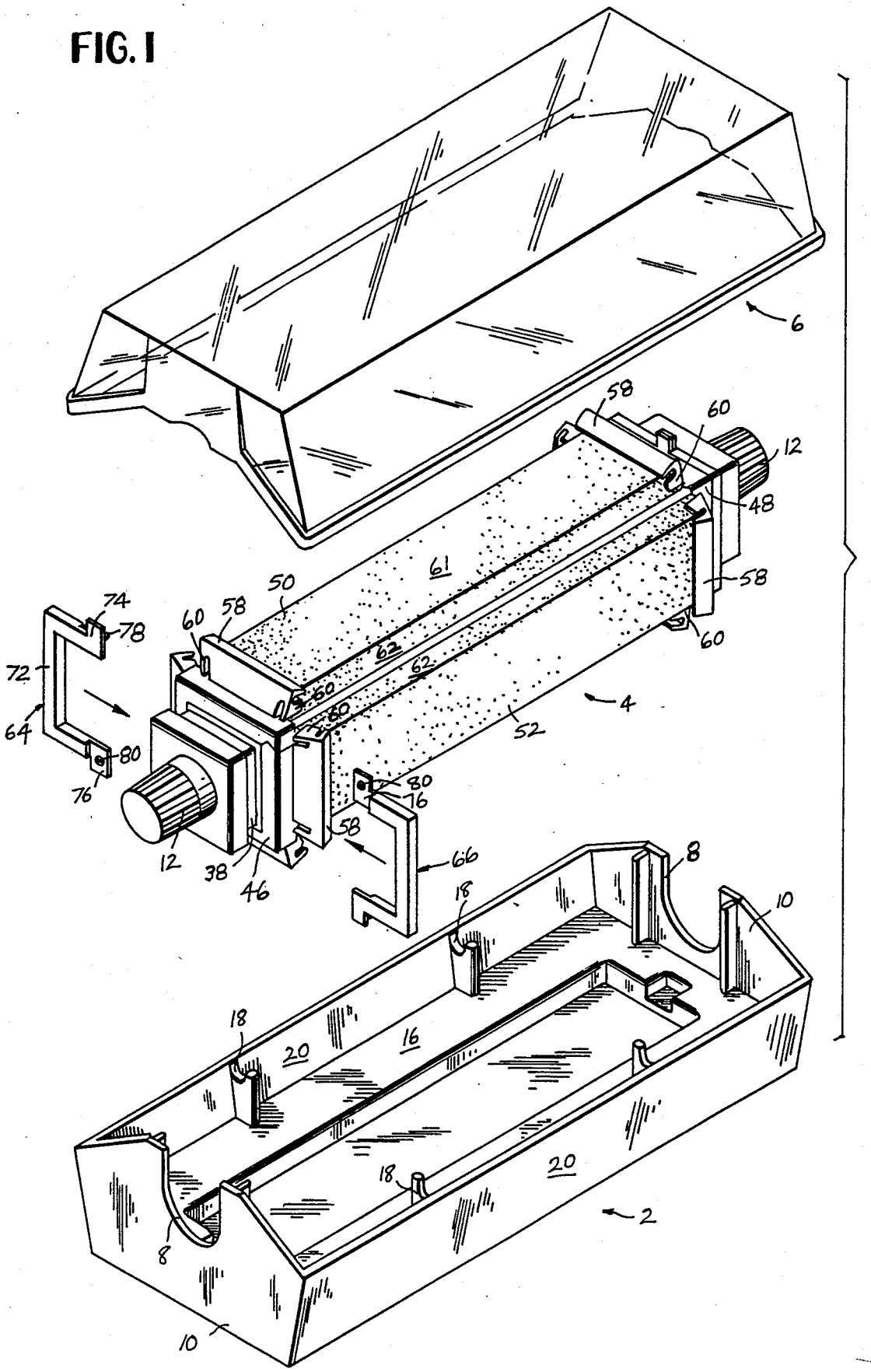
FIG. 1 is an exploded view of a multiple stone sharpening device of the invention.
Figure 2:
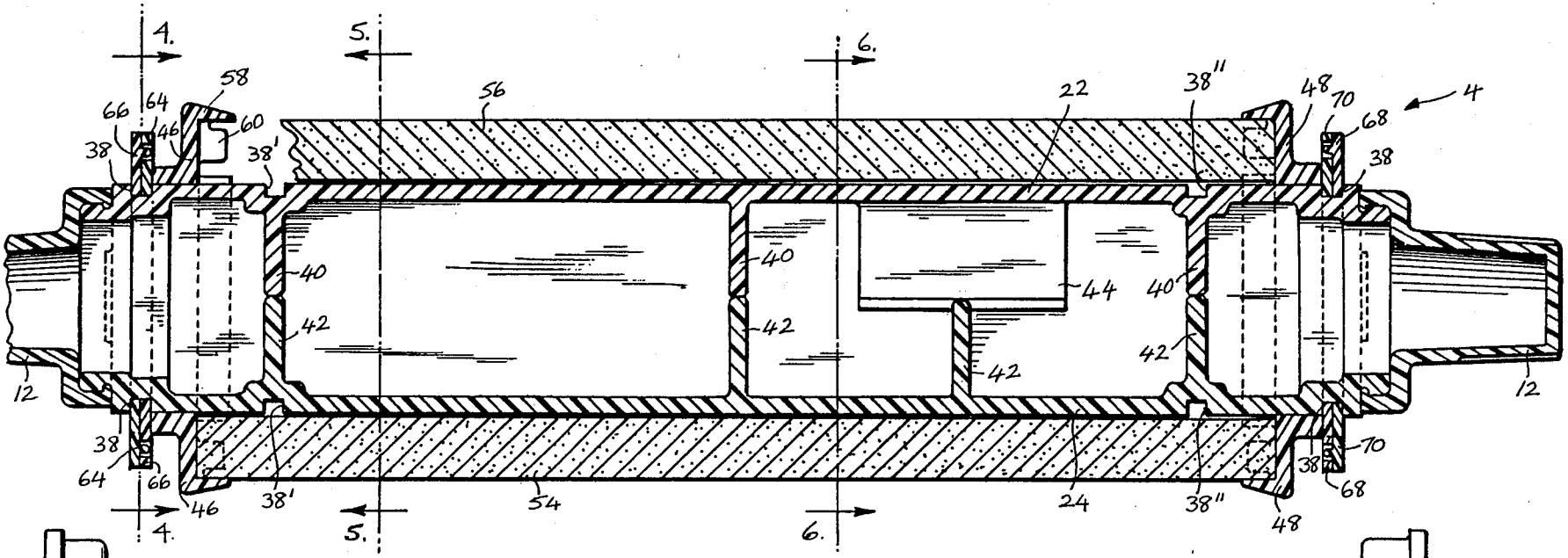
FIG. 2 is a longitudinal cross-sectional view of the stone holder shown in FIG. 1.
Figure 3:
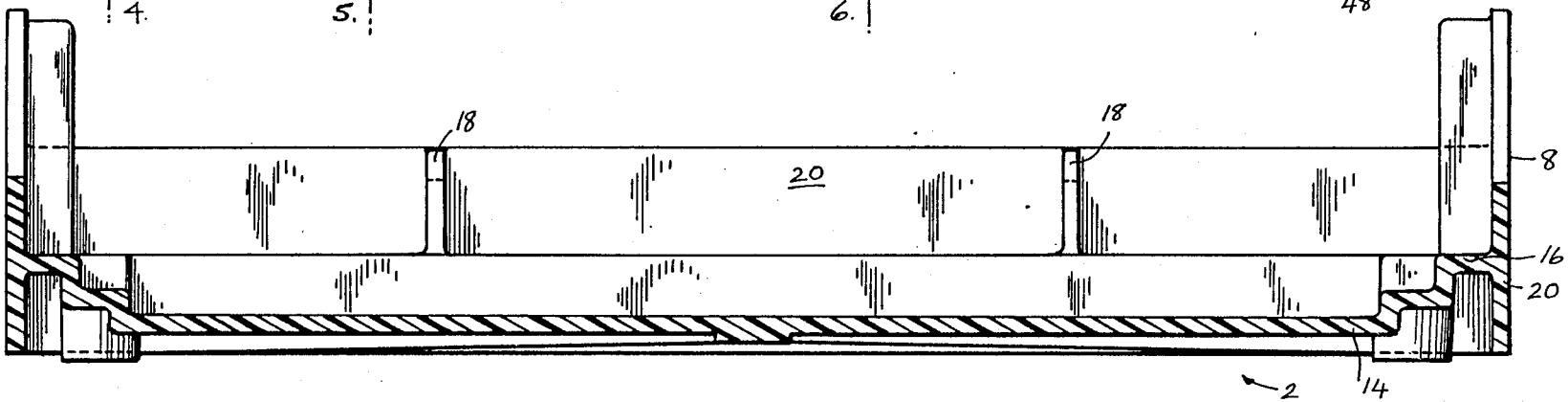
FIG. 3 is a longitudinal cross-sectional view of the tray shown in FIG. 1.

With reference to the figures, in which like numerals represent like parts, FIGS. 1 through 6 show details of the invention. FIG. 1 shows an exploded view of the device of the invention in which base 2 supports stone holder 4, and cover 6 protects the device when it is not in use.

Base 2, which acts as a stand for the stone holder, has rest 8 for each handle of stone holder 4 formed in each end 10 of the stand. Rest 8 may, for example, be substantially semi-circular in shape if handles 12 of stone holder 4 have a circular perimeter. Base 2 is generally shaped as an open box, and when handles 12 rest in portions 8, one of the sharpening stones may rest in depression 14 in lower surface 16 of base 2. Holders 18, positioned against side walls 20, may optionally be used to hold rod-shaped sharpening devices. Other configurations of the base are within the scope of the invention, including variations according to other numbers of stones held by stone holder 4.

Cover 6 rests over stone holder 4 on top of base 2, to provide a dust cover for the stone holder when it is not in use. Base 2 may be made of rigid plastic material, and cover 6 is likewise, preferably made of rigid plastic material. Cover 6 is optionally transparent. Other suitable materials are known to one skilled in the art.

Figure 4:
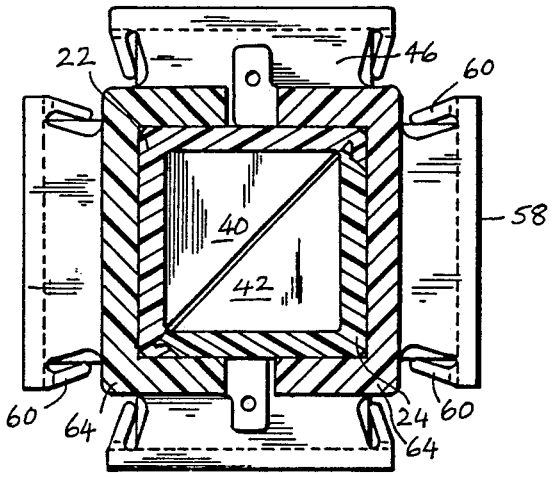
FIG. 4 is a cross-sectional view of the stone holder taken on line 4—4 of FIG. 2.
Figure 5:
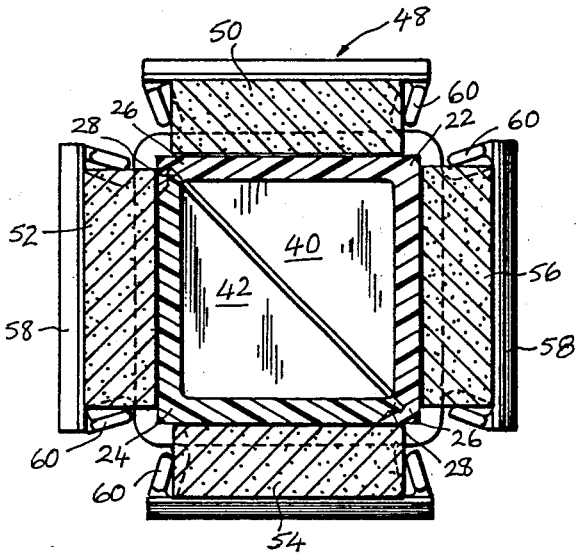
FIG. 5 is a cross-sectional view of the stone holder taken on line 5—5 of FIG. 2.
Figure 6:
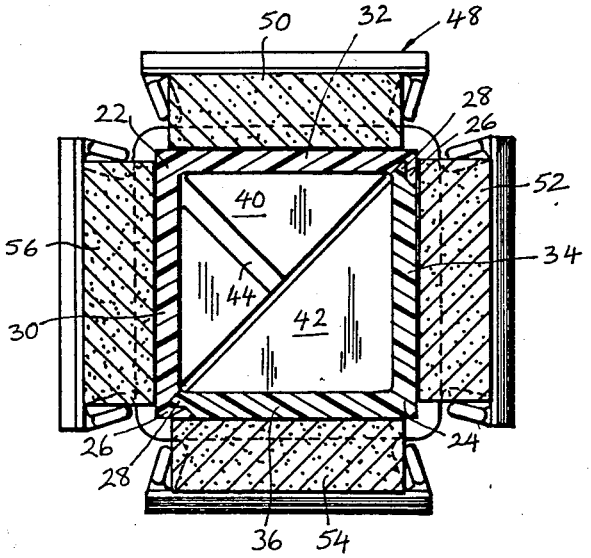
FIG. 6 is a cross-sectional view of the stone holder taken on line 6—6 of FIG. 2.

Stone holder 4 is shown in detail in FIGS. 1, 2 and 4 through 6. Stone holder 4 has an elongated core on which the stones are supported. The core is made of two portions 22 and 24 which engage slidingly together. FIGS. 4 to 6 illustrate L-shaped member 24 having its edges slidingly engaged within the edges of L-shaped member 22. Member 22 has flanges 26 along the length of each side and member 24 has bevelled edges 28 along the length of each side which slidingly engage under flanges 26. Member 22 has two elongated, substantially planar sides 30 and 32, extending substantially perpendicular to each other. Sides 30 and 32 each have flange 26 extending from its outer longitudinal edge. Member 24 likewise has two sides 34 and 36, substantially perpendicular to each other, and each side has a bevelled portion 28 at its outer end. Thus, members 22 and 24 engage together to form an elongated stone holder 4 having a substantially square cross-section.

Each member 22 and 24 has a plurality of grooves 38 perpendicular to the longitudinal edges of sides 30, 32, 34 and 36, providing alternative positions for retainers for the sharpening stones. Grooves 38 extend transversely around the perimeter of stone holder 4 when members 22 and 24 are assembled together. Members 22 and 24 may also each include interior strengthening members 40, 42, respectively, which provide structural support for stone holder 4. An alternative form of structural support is shown by support 44 engaged with support 40.

Retainers 46 and 48 engage stones 50, 52, 54 and 56 at each end thereof. Each retainer 46, 48 has a stone-engaging flange portion 58 which engages the outer surface of each stone and a stone-engaging portion 60 extending from stoneengaging flange portion 58 adjacent each side surface of the stone. Each stone is thus gripped at each end on its outer surface 61 and on each exposed longitudinal side surface 62.

Each retainer 46, 48 is held in place by a pair of engaged retaining members 64, 66 and 68, 70. Each pair of engaged retaining members comprises two identical members which fit together in interlocking engagement in a groove 38, holding stone end retainers 46, 48, in place. Each member 64, 66, 68 and 70 has a portion 72 which surrounds half of the perimeter of stone holder 4, and a tab 74, 76 extending outwardly from each end thereof. Tab 74 has a projection 78 extending therefrom which engages with aperture 80 in tab 76 of the other of the pair of engaged retainer members. Members 64, 66 and members 68, 70 are engaged in interlocking relationship in a groove 38 at each end of the device, immediately adjacent stone holding retainers 46, 48 respectively. Thus, the stones are held between stone holding retainers 46, 48, which in turn are held by members 64, 66 and 68, 70. Should the stones each be of a shorter length, inner grooves 38' and/or 38" shown on FIG. 2 may be used instead of one or both of the outer grooves 38 in which members 64, 66, 68, 70 are illustrated as being retained. Grooves 38 are located according to standard lengths of stone. For example, sharpening stones may be six, seven or eight inches in length, and this variation is accommodated by the inventive sharpening stone holder by varying the positions of the stone holding retaining members 64, 66 and 68, 70 in grooves 38, 38' or 38".

The stone holder of the invention may be adapted for holding different numbers of stones, as will be apparent to one skilled in the art.

The device may appropriately be made of plastic, and may be dismantled completely if necessary. End retaining members 64, 66, 68 and 70 are easily removed to allow stone holding retainers 46, 48 to be removed and, thus, the stones may be removed from the holder. Should there by any necessity to dismantle the device further, handles 12 may be removed and disengaged from assembled members 22, 24. Members 22, 24 may be disengaged by sliding apart longitudinally, if required. This should not be necessary during normal use, but the device may be dismantled for replacement of any of the parts, if necessary.

While the invention has been described above with respect to certain embodiments thereof, it will be appreciated that variations and modifications may be made without departing from the spirit and scope of the invention.

What is claimed is:

1. A sharpening device comprising:

means for supporting a plurality of sharpening stones, said means being adaptable for holding sharpening stones of different lengths;

means for retaining end portions of said stones engaging around the perimeter of the supporting means adjacent end portions of the stones; and means for locking said end portion retaining means in position adjacent said stones, said locking means engaging around the perimeter of the supporting means adjacent said end portion retaining means.

2. A sharpening device of claim 1 wherein the retaining means engages the outer surface of each stone.

3. A sharpening device of claim 1 wherein the retaining means engages the longitudinal side surfaces of each stone.

4. A sharpening device of claim 2 wherein the retaining means engages the longitudinal side surfaces of each stone.

5. A sharpening device of claim 1 wherein the locking means comprises at least one locking member engaged adjacent the retaining means.

6. A sharpening device of claim 5 wherein the at least one locking member is engaged in a groove in said supporting means.

7. A sharpening device of claim 6 wherein the device comprises a plurality of grooves spaced apart from each other according to the length of the sharpening stones, and the groove engaged by a locking member is selected according to the length of the sharpening stones used.

8. A sharpening device of claim 7 further comprising a plurality of sharpening stones supported on the device.

9. A sharpening device of claim 1 further comprising a plurality of sharpening stones supported on the device.

10. A sharpening device comprising:

supporting means for at least one sharpening stone;

a pair of stone holding members engaged with said supporting means for holding each end portion of said at least one stone;

locking means for positioning adjacent said stone holding members engaging around the perimeter of the supporting means for retaining the stone holding members in position on the supporting means engaged with said at least one sharpening stone, wherein the supporting means comprises at least one groove in the perimeter of the supporting means for engaging said locking means, said groove being selected according to the length of the sharpening stones being locked in place.

11. A sharpening device of claim 10 wherein the spaced-apart means comprises a plurality of grooves in said supporting means.

12. A sharpening device of claim 10 wherein the stone holding members engage the end portions of each stone on the outer surface and on each side surface.

13. A sharpening device of claim 10 wherein said locking means comprises two halves each sized to engage in the at least one groove in the perimeter of the supporting means.

14. A sharpening device of claim 13 wherein each half of said locking means comprises tab means for locking to tab means of each other half of said locking means when said locking means is recessed in said grooves.

15. A sharpening device comprising:

means for supporting a plurality of sharpening stones, said means being adaptable for holding sharpening stones of different lengths;

means for retaining end portions of said stones engaging closely around the perimeter of the supporting means; and means for locking said end portion retaining means in position, said locking means engaging closely around the perimeter of the supporting means adjacent the end portion retaining means.

16. A sharpening device of claim 15 further comprising at least one groove in the perimeter of the supporting means for engaging the locking means adjacent the end portion retaining means.

* * * * *